US006827346B2

(12) United States Patent
Villanueva et al.

(10) Patent No.: US 6,827,346 B2
(45) Date of Patent: Dec. 7, 2004

(54) METHOD AND APPARATUS FOR MAKING BOOKLETS

(75) Inventors: Jose Alvaro Barba Villanueva, Jalisco (MX); Francisco Javier Ramirez Aldana, Jalisco (MX); Robert J. Lawton, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/426,325

(22) Filed: Apr. 30, 2003

(65) Prior Publication Data

US 2004/0217535 A1 Nov. 4, 2004

(51) Int. Cl.[7] ..... B65H 37/04

(52) U.S. Cl. ..... 270/52.26; 270/52.17; 270/52.18; 83/934

(58) Field of Search ..... 270/52.17, 52.26, 270/52.3, 58.07, 52.18, 532, 52.76; 83/934, 83, 84, 90, 451, 452, 453, 454; 493/356, 357, 360, 384, 354; 412/6, 16

(56) References Cited

U.S. PATENT DOCUMENTS

| | | | | | |
|---|---|---|---|---|---|
| 1,028,708 | A | * | 6/1912 | Gitzendaner | 270/37 |
| 1,750,622 | A | * | 3/1930 | Belluche | 270/52.18 |
| 3,692,299 | A | * | 9/1972 | McCahon et al. | 270/52.26 |
| 3,797,419 | A | * | 3/1974 | Depetris | 112/21 |
| 4,164,159 | A | * | 8/1979 | Marciniak | 83/280 |
| 4,576,369 | A | * | 3/1986 | Flensburg et al. | 270/52.17 |
| 4,592,651 | A | * | 6/1986 | Oikawa et al. | 355/72 |
| 4,595,187 | A | * | 6/1986 | Bober | 270/37 |
| 5,086,681 | A | * | 2/1992 | Ruetschle et al. | 83/277 |
| 5,108,081 | A | | 4/1992 | Russel | |
| 5,377,569 | A | * | 1/1995 | Richards et al. | 83/98 |
| 5,377,965 | A | | 1/1995 | Mandel | |
| 5,547,176 | A | | 8/1996 | Williams | |
| 5,685,530 | A | | 11/1997 | DeLise | |
| 5,803,891 | A | * | 9/1998 | Haan et al. | 493/442 |
| 6,199,851 | B1 | | 3/2001 | Latvakangas | |
| 6,276,677 | B1 | | 8/2001 | Hommochi | |
| 6,354,059 | B1 | | 3/2002 | Yoshie | |
| 6,363,851 | B1 | | 4/2002 | Gerhard | |
| 6,572,093 | B1 | * | 6/2003 | Scholta | 270/52.17 |
| 2003/0161704 | A1 | * | 8/2003 | Trovinger | 412/25 |

* cited by examiner

*Primary Examiner*—Patrick Mackey
(74) *Attorney, Agent, or Firm*—James R. McDaniel

(57) ABSTRACT

This invention relates to a method and apparatus for making booklets. Such structures of this type, generally, employ a saddle, a plurality of skis, and a cutting mechanism to retain and cut individual sheets of media and, subsequent, fasten the individual sheets to form the booklet.

12 Claims, 5 Drawing Sheets

METHOD AND APPARATUS FOR MAKING BOOKLETS

BACKGROUND OF THE INVENTION

1. Field of the Invention

This invention relates to a method and apparatus for making booklets. Such structures of this type, generally, employ a saddle, a plurality of skis, and a cutting mechanism to retain and cut individual sheets of media and, subsequently, fasten the individual sheets to form the booklet.

2. Description of the Related Art

Prior to the present invention, as set forth in general terms above and more specifically below, it is known, in the booklet making art, to utilize an "Inside-Out" method for making booklets. The Inside-Out method refers to the method of placing the furtherest inside sheet of the booklet over the saddle and stacking subsequent sheets on top. The cover, if needed, is a then placed over the last stacked sheet. This bundle is then fastened to form a booklet. It is also to be understood that an "Outside-In" method can be utilized. The "Outside-in" method is basically the opposite of the "Inside-Out" method in that the cover is handled first and the furtherest inside sheet of the booklet is handled last. Exemplary of such prior art is U.S. Pat. No. 6,363,851 ('851) to J. Gerhard et al., entitled "Process for Producing Folded, Bound Printed Products, and the Printed Product Produced." While the '851 reference uses the "Inside-Out" technique, the finished booklet includes sheets of the same lengths which results in an unattractive V-shaped creep or chevron edge along the booklet edge. Consequently, a more advantageous system, then, would be provided if the V-shaped creep or chevron edge could be eliminated.

It is also known, in the booklet making art, to utilize a trimming device that eliminates the V-shaped edge. Exemplary of such prior art are U.S. Pat. No. 5,377,965 ('965) to B. P. Mandel et al., entitled "Automatic On-Line Signature Booklets Finisher for Electronic Printers" and U.S. Pat. No. 5,547,176 ('176) to G. C. Williams et al., entitled "Apparatus and Method for Binding Pseudo-Signatures into a Booklet." While the '965 and '176 references utilize a guillotine-type trimmer to eliminate the V-shaped creep or chevron edge along the booklet, these devices are expensive, massive, cumbersome, and mechanically/electronically complex. Therefore, a further advantageous system, then, would be provided if the V-shaped creep or chevron edge could be inexpensively and easily removed.

Finally, it is known to cut the individual sheets of the booklet progressively longer (shorter for Outside-In) in order to avoid the creep effect.

It is apparent from the above that there exists a need in the art for a booklet making system which is lightweight through simplicity of parts and uniqueness of structure, and which at least equals the booklet making characteristics of the known booklet making systems, but which at the same time can inexpensively eliminate the V-shaped creep or chevron edge. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a booklet making apparatus, wherein the apparatus is comprised of: a media guide; a media sheet holder located along a portion of the media guide; a media sheet saddle having a first end located adjacent to the media guide; an individual sheet cutter located adjacent to a second end of the media sheet saddle; and a booklet fastener located adjacent to the media guide.

In certain preferred embodiments, the media guide includes a curved portion that allows the single sheet of media to traverse along both sides of the saddle. Also, the media sheet holder includes movable skis having rotatable ski arms that can be used to hold the media against the saddle. Also, the sheet cutter is used to cut each, individual sheet of media as the sheet of media is held in place against the saddle by the skis. Finally, the apparatus includes a creasing device to crease the booklet spine in order to eliminate any raised areas or "pillowing" along the booklet spine. In another further preferred embodiment, the V-shaped creep or chevron edge along the booklet is eliminated by employing an "Inside-Out" technique that trims the sheets at different lengths as the sheets are stacked upon each other prior to fastening the sheets together in order to form the booklet. In this manner, the inside sheets will be cut shorter than the outside sheets in order to eliminate the creep or chevron edge. The preferred booklet making apparatus, according to various embodiments of the present invention, offers the following advantages: lightness in weight; ease-of-use; good stability; good durability; excellent booklet making characteristics; compactness in size; and excellent economy. In fact, in many of the preferred embodiments, these factors of lightness in weight, ease-of-use, excellent booklet making characteristics, compactness in size, and excellent economy are optimized to an extent that is considerably higher than heretofore achieved in prior, known booklet making apparatus. The above and other features of the present invention, which will become more apparent as the description proceeds, are best understood by considering the following detailed description in conjunction with the accompanying drawings, wherein like characters represent like parts throughout the several views and in which:

DETAILED OF THE INVENTION

Figure 1:
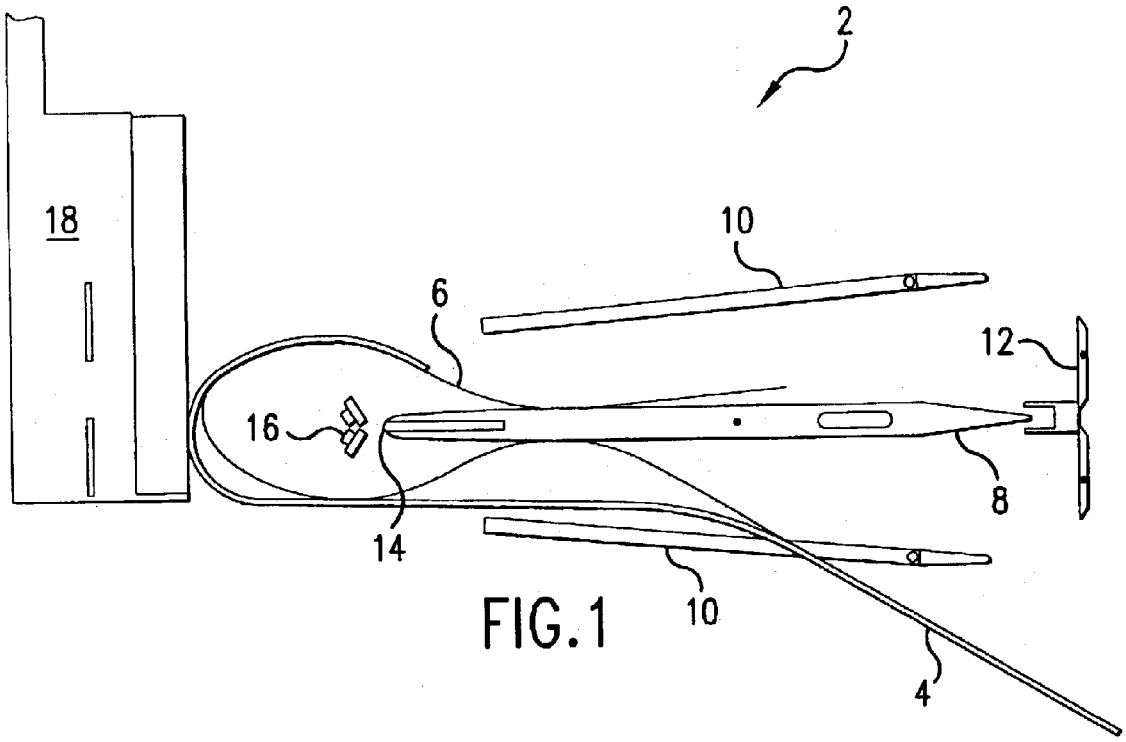
FIG. 1 is a schematic illustration of an accumulation step used by a method and apparatus for making booklets, according to one embodiment of the present invention.

With reference first to FIG. 1, there is illustrated one preferred embodiment for use of the concepts of this invention. FIG. 1 illustrates apparatus 2 for making booklets. Apparatus 2 includes, in part, media guide 4, media 6, saddle 8, skis 10, media cutter 12, crease wire 14, scoring/creasing rollers 16, fastener 18, and pivotable ski arms 20.

Media guide 4, preferably, is constructed of any suitable, durable material that is capable of being formed into a curvilinear shape. Media 6, preferably, is any suitable media that can be formed into a booklet. Saddle 8, preferably, is constructed of any suitable, durable material that is capable of handling media 6, scoring/creasing rollers 16, and fastener 18. Skis 10 and ski arms 20, preferably, are constructed of any suitable, durable material that is capable of holding media 6 against saddle 8. Cutter 12, preferably, is any suitable cutting device that is capable of cutting/trimming individual sheets of media 6. Crease wire or anvil 14, preferably, is constructed of any suitable, durable material that is capable of pushing a portion of media 6 up against scoring/creasing rollers 16 in order to score/crease media 6. Scoring/creasing rollers 16, preferably, are any suitable scoring/creasing rollers that are capable of scoring/creasing a portion of media 6. Finally, fastener 18, preferably, is any suitable fastening device, such as a stapler, that is capable of fastening the sheet bundle 50 (FIG. 5) in order to form the booklet.

With respect to FIG. 1, a single sheet of media 6 is traversed along media guide 4 such that media 6 interacts with saddle 8. As can be seen in FIG. 1, skis 10 are in a raised position.

Figure 2:
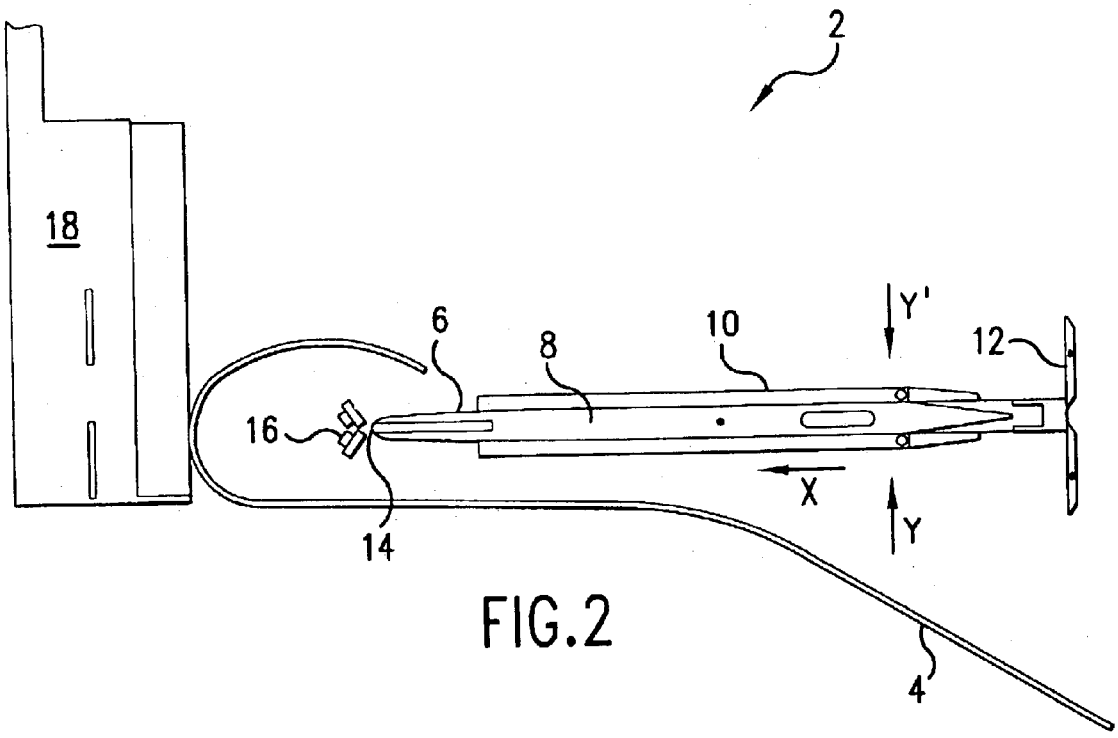
FIG. 2 is a schematic illustration of another accumulation step used by the method and apparatus for making booklets, according to another embodiment of the present invention.

With respect to FIG. 2, the middle of the sheet of media 6 will stop substantially over top of crease wire 14. Skis 10 are then have moved along the direction of arrows Y and Y' in order to hold the sheet of media 6 against saddle 8. Saddle 8 is then moved in the direction of arrow X in order to accommodate the position of media 6 in saddle 8. It is to be understood that skis 10 hold the sheet of media 6 in place, tightly around saddle 8 or around all previous sheets of media 6. The previous ends of sheets of media 6 are currently hidden inside the; funnel-like cavity of cutter 12 and saddle 8 runs in a direction opposite to the one of arrow X against a precision hard stop (not shown). By doing that, the new end of sheets of media 6 hangs over the cutting edge of cutter 12 by the exact amount given by the number and thickness of all previous sheets of media 6. Immediately after that, the trimming operation occurs. Saddle 8 then moves towards the creasing step by giving space for the flippers 20 to push the newly trimmed edge of media 6 along with all previous ones inward. When saddle 8 returns to the accumulation position, all those edges of media 6 are hidden in the funnel and the next sheet of media 6 enters apparatus 2.

Figure 3:
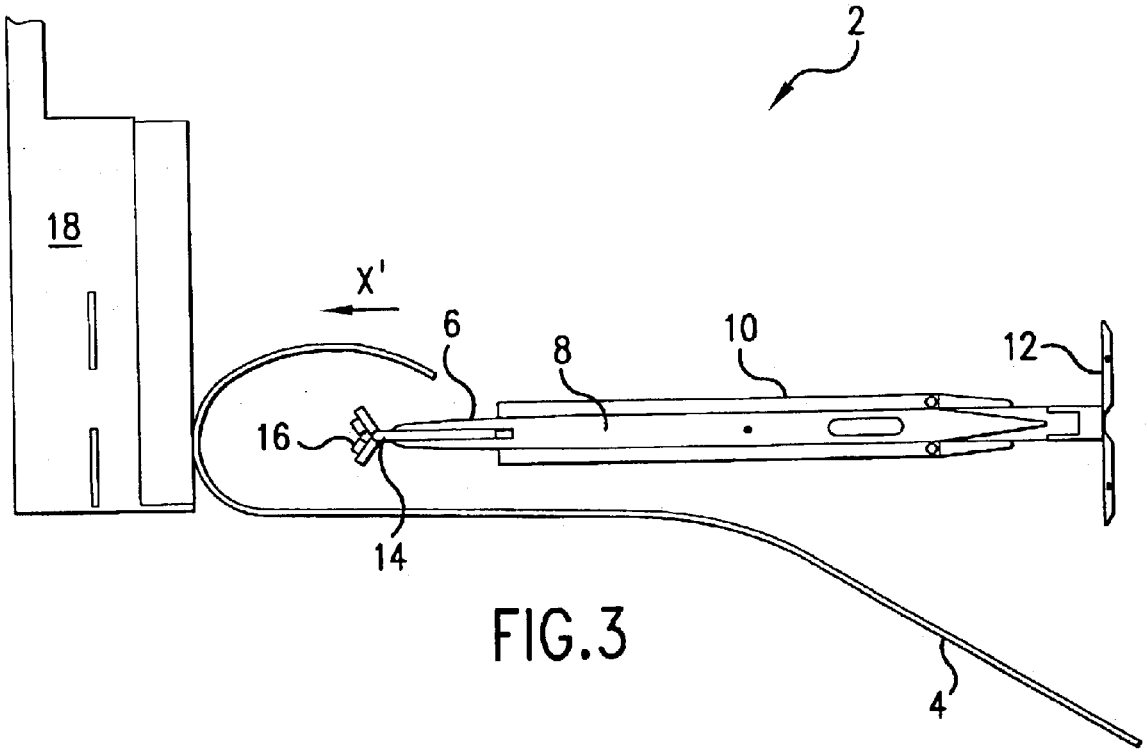
FIG. 3 is a schematic illustration of a scoring/creasing step used by the method and apparatus for making booklets, according to another embodiment of the present invention.

With respect to FIG. 3, crease wire 14 is extended along the direction of arrow X' into scoring/creasing rollers 16 such that a portion of media 6 is conventionally scored/creased by rollers 16 along a length of media 6. It is to be understood that creasing/scoring step could be completed before or after the accumulating and/or trimming steps. This scoring/creasing should also weaken the media 6 in that location in order that media 6 stays folded. A "No pillowing" characteristic should be a result of the effectiveness of the crease operation.

Figure 4:
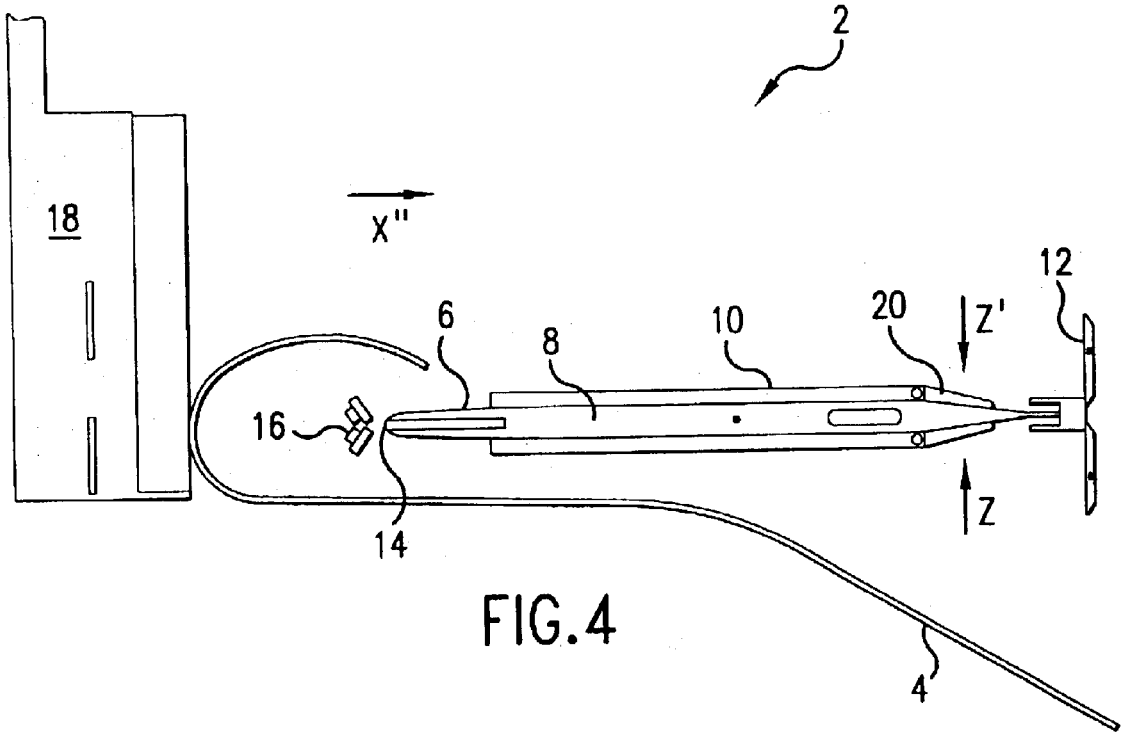
FIG. 4 is a schematic illustration of a media cutting step used by the method and apparatus for making booklets and shows how all the cut ends are hidden inside the funnel-like cutter, according to another embodiment of the present invention.

With respect to FIG. 4, crease wire 14 and media 6 are traversed along the direction of arrow X". Ski arms 20 are pivoted along the directions of arrows Z and Z' in order to hide the edges of media 6 inside the base of cutter 12 so that the edges of media 6 can be cut by cutter 12. This is done in order that the next sheet of media 6 will lie over the blades of cutter 12 without any interference with previous sheets of media 6.

Individual sheets of media 6 are continuously stacked upon previously cut sheets of media until the desired number of sheets of media 6 in the booklet is reached. In this manner, the edges of the sheets of media 6 hang less and less over the blades of cutter 12 so that an even appearance along the edge of the finished booklet is achieved.

Figure 5:
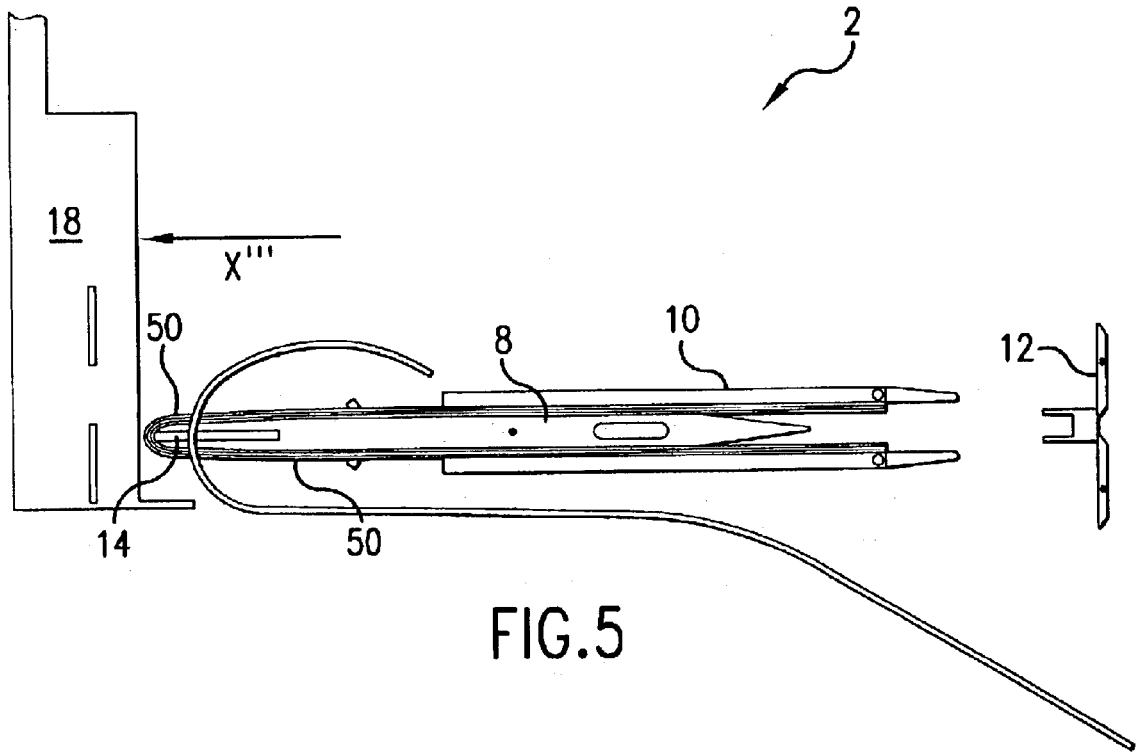
FIG. 5 is a schematic illustration of the complete booklet going through the fastening or stitching step used by the method and apparatus for making booklets, according to another embodiment of the present invention.

With respect to FIG. 5, once all of the sheets of media 6 are in place and trimmed by cutter 12 in order to complete a bundle 50, saddle 8 moves in the direction of arrow X'" so that bundle 50 fastened/stitched in order to form a booklet. The booklet is then conventionally removed from apparatus 2 and a new bundle 50 is started in apparatus 2.

Also, the present invention can be embodied in any computer-readable medium for use by or in connection with an instruction execution system such as a computer/processor based system or other system that can fetch or obtain the logic from the computer-readable medium and execute instructions contained therein. A "computer-readable medium" can be any medium that contains, stores, or maintains programming for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A booklet making apparatus, comprising:

a media guide;

a media sheet holder located along a portion of the media guide, wherein the media sheet holder is further comprised of; a plurality of skis substantially located on both sides of said media sheet saddle wherein a ski arm is operatively connected to each of said plurality of skis;

a media sheet saddle having a first end located adjacent to the media guide;

an individual sheet cutter located adjacent to a second end of the media sheet saddle; and a booklet fastener located adjacent to the media guide.

2. The booklet making apparatus, as in claim 1, wherein said media guide is further comprised of:

a curvilinear media guide.

3. The booklet making apparatus, as in claim 1, wherein said media sheet saddle is further comprised of:

a crease wire located substantially near said first end of said media sheet saddle.

4. The booklet making apparatus, as in claim 1, wherein said booklet fastener is further comprised of:

a stapler.

5. The booklet making apparatus, as in claim 1, wherein said apparatus is further comprised of:

a plurality of scoring/creasing rollers located substantially adjacent to said crease wire.

6. A booklet making means, comprising:

a media sheet saddle means;

a media guide means for guiding a single sheet of media substantially around said media sheet saddle means;

a media sheet holder means for holding said media substantially against said media sheet saddle means, wherein said media sheet holder means is further comprised of; an arm means operatively connected to said media sheet holder means for holding a portion of said media so that said edges of said media can be cut;

an individual sheet cutter means for cutting edges of said media; and a booklet fastener means for fastening a plurality of individual cut sheets of media in order to form a booklet.

7. The booklet making means, as in claim 6, wherein said booklet making means is further comprised of:

a scoring/creasing means for scoring/creasing a portion of said single sheet of media.

8. The booklet making means, as in claim 7, wherein said media sheet saddle means is further comprised of:

a crease wire means for extending a portion of said media into said scoring/creasing means.

9. A program storage medium readable by a computer, tangibly embodying a program of instructions executable by the computer to perform method steps for a method for making a booklet, comprising the steps of:

traversing a single sheet of media along a media guide and a saddle;

securing said media to said saddle;

scoring/creasing a portion of said media;

cutting a plurality of edges of said media, wherein said cutting step is further comprised of the steps of; securing a portion of said media substantially near said plurality of edges of said media by moving a plurality of ski arms into contact with said saddle, and cutting, if necessary, a portion of said media with a cutter;

completing said traversing, securing, scoring/creasing, and cutting steps until a desired amount of media to construct a bundle has been achieved; and fastening said bundle in order to create a booklet.

10. The method, as in claim 9, wherein said securing step is further comprised of the step of:

moving a plurality of skis into contact with a saddle.

11. The method, as in claim 9, wherein said scoring/creasing step is further comprised of the steps of:

traversing a crease wire and said portion of said media from said saddle into a plurality of scoring/creasing rollers; and scoring/creasing a portion of said media with said plurality of scoring/creasing rollers.

12. The method, as in claim 9, wherein said fastening step is further comprised of a step of:

stapling said bundle.

* * * * *